US007656381B2

(12) United States Patent
Luo

(10) Patent No.: US 7,656,381 B2
(45) Date of Patent: Feb. 2, 2010

(54) SYSTEMS FOR PROVIDING DUAL RESOLUTION CONTROL OF DISPLAY PANELS

(75) Inventor: Ping Luo, Hsinchu (TW)

(73) Assignee: TPO Displays Corp., Chu-Nan, Miao-Li County (TW)

( * ) Notice: Subject to any disclaimer, the term of this patent is extended or adjusted under 35 U.S.C. 154(b) by 687 days.

(21) Appl. No.: 11/330,006

(22) Filed: Jan. 11, 2006

(65) Prior Publication Data

US 2007/0159502 A1 Jul. 12, 2007

(51) Int. Cl.
*G09G 3/36* (2006.01)

(52) U.S. Cl. ..... 345/100; 345/698

(58) Field of Classification Search ..... 345/83–104, 345/204, 698; 377/78, 76, 105
See application file for complete search history.

(56) References Cited

U.S. PATENT DOCUMENTS 5,517,542 A * 5/1996 Huq ..... 377/78
5,682,175 A * 10/1997 Kitamura ..... 345/98
5,859,630 A * 1/1999 Huq ..... 345/100
6,362,643 B1 3/2002 Kim ..... 324/770
6,747,626 B2 6/2004 Chiang ..... 345/98
6,778,103 B2 8/2004 Satoh ..... 341/51
6,788,280 B2 9/2004 Ham ..... 345/89
6,795,050 B1 9/2004 Ino et al. ..... 345/100
2002/0163493 A1 * 11/2002 Matsushima et al. ..... 345/98
2003/0030615 A1 * 2/2003 Maeda et al. ..... 345/90
2004/0008173 A1 * 1/2004 Maeda et al. ..... 345/99
2005/0068287 A1 3/2005 Lin et al. ..... 345/100

* cited by examiner

*Primary Examiner*—Chanh Nguyen
*Assistant Examiner*—Tsegaye Seyoum
(74) *Attorney, Agent, or Firm*—Thomas, Kayden, Horstemeyer & Risley

(57) ABSTRACT

Systems for providing dual resolution control of display panels are provided. A representative system incorporates two pairs of shift registers, each of the shift registers outputting a shifting signal; two pairs of logic gates; and a switching network coupled among the shifting registers and the logic gates. In a low resolution mode, the switching network causes the shift registers to output shifting signals, with corresponding pulses of the shifting signals of the shift registers of the first pair temporally overlapping with corresponding pulses of the shifting signals of the shift registers of the second pair; and wherein, responsive to the shifting signals, the logic gates output panel control signals, with corresponding pulses of the panel control signals of the logic gates of the first pair not temporally overlapping with corresponding pulses of the panel control signals of the logic gates of the second pair.

11 Claims, 9 Drawing Sheets

SYSTEMS FOR PROVIDING DUAL RESOLUTION CONTROL OF DISPLAY PANELS

BACKGROUND OF THE INVENTION

1. Field of the Invention

The present invention relates to dual resolution control of display panels.

2. Description of the Related Art

Display panels are driven by a series of panel control signals, such as the panel control signals 105~108 depicted in FIG. 1. These panel control signals provide a series of pulses, which are used to switch data signals into correct data lines for correct pixels, and to load data signals into pixels on each scan line. Panel control signals are usually generated from shifting signals, such as the shifting signals 101~104 in FIG. 1.

FIG. 2 is a schematic diagram showing part of the conventional control circuit 200 for generating panel control signals. The control circuit 200 comprises shift registers, logic gates and a switching network 100. Each of the shift registers SR1~SR4 receives clock signals CK1 and CK2, as well as a corresponding shifting signal (101~104) from a previous shift register. Each of the shift registers also outputs its own shifting signal to a next shift register, to a corresponding logic gate, and to a next logic gate. The clock signals CK1 and CK2 have the same frequency and are always in opposite phases, as depicted in FIG. 3. Each of the logic gates G1~G4 receives two shifting signals and outputs a panel control signal (105~108). The logic gates G1~G4 in the control circuit 200 are AND gates to generate panel control signals with high pulses. Thus, the logic gates G1~G4 generate the panel control signals 105~108 according to the shifting signals 101~104, which are generated from switching network 100.

For many applications, it is desirable to have display panels support two resolutions, usually a high resolution, such as the VGA (video graphic array) resolution of 640 columns by 480 rows, and a low resolution, such as the QVGA (quarter video graphic array) resolution of 320 columns by 240 rows. In this regard, low resolution typically is achieved by filling identical data into adjacent pixels, so that four adjacent pixels are consolidated into a larger pixel. To implement such low resolution, panel control signals typically are synchronized into pairs, such as shown by the panel control signals 401~404 in FIG. 4. Notably, the interconnection among shift registers and logic gates typically has to be adjusted for changing resolution. The adjustment is usually implemented with a switching network.

Regarding switching network 100, in some conventional designs, half of the existing shift registers may not used when the display panel scans upward or downward in the low resolution mode. Unused shift registers are in a floating state and tend to accumulate charges. If the voltage generated by accumulated charges is higher than the highest operating voltage of the display panel or lower than the lowest operating voltage of the display panel, there can be errant operations in the display panel, potentially causing abnormalities.

SUMMARY OF THE INVENTION

Systems for providing dual resolution control of display panels are provided. In this regard, an exemplary embodiment of such a system comprises: a dual resolution control circuit comprising four shift registers, each of the shift registers outputting a shifting signal; four logic gates; and a switching network, coupled among the shifting registers and the logic gates. In a low resolution mode, the switching network directs the shifting signals to the shift registers such that each of the first and the second shift registers outputs a first shifting signal and each of the third and the fourth shift registers outputs a second shifting signal, the switching network also directs the shifting signals to the logic gates such that each of the first and the second logic gates outputs a first panel control signal and each of the third and the fourth logic gates outputs a second panel control signal, and wherein pulses of the first and the second panel control signals do not temporally overlap.

Another embodiment of such a system comprises: a data driver circuit operative to provide an image signal; a dual resolution control circuit operative to provide a plurality of panel control signals; the control circuit comprising four shift registers, each of the shift registers outputting a shifting signal; four logic gates; and a switching network, coupled among the shifting registers and the logic gates. In a low resolution mode, the switching network directs the shifting signals to the shift registers such that each of the first and the second shift registers outputs a first shifting signal and each of the third and the fourth shift registers outputs a second shifting signal, the switching network also directs the shifting signals to the logic gates such that each of the first and the second logic gates outputs a first panel control signal and each of the third and the fourth logic gates outputs a second panel control signal, and wherein pulses of the first and the second panel control signals do not temporally overlap; and a pixel array for displaying an image by loading the image signal into a plurality of pixels of the pixel array in response to the panel control signals. Another embodiment of such a system comprises: a first pair and a second pair of shift registers, each of the shift registers outputting a shifting signal; a first pair and a second pair of logic gates; and a switching network coupled among the shifting registers and the logic gates. In a low resolution mode, the switching network causes the shift registers to output shifting signals, with corresponding pulses of the shifting signals of the shift registers of the first pair temporally overlapping with corresponding pulses of the shifting signals of the shift registers of the second pair; and wherein, responsive to the shifting signals, the logic gates output panel control signals, with corresponding pulses of the panel control signals of the logic gates of the first pair not temporally overlapping with corresponding pulses of the panel control signals of the logic gates of the second pair.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
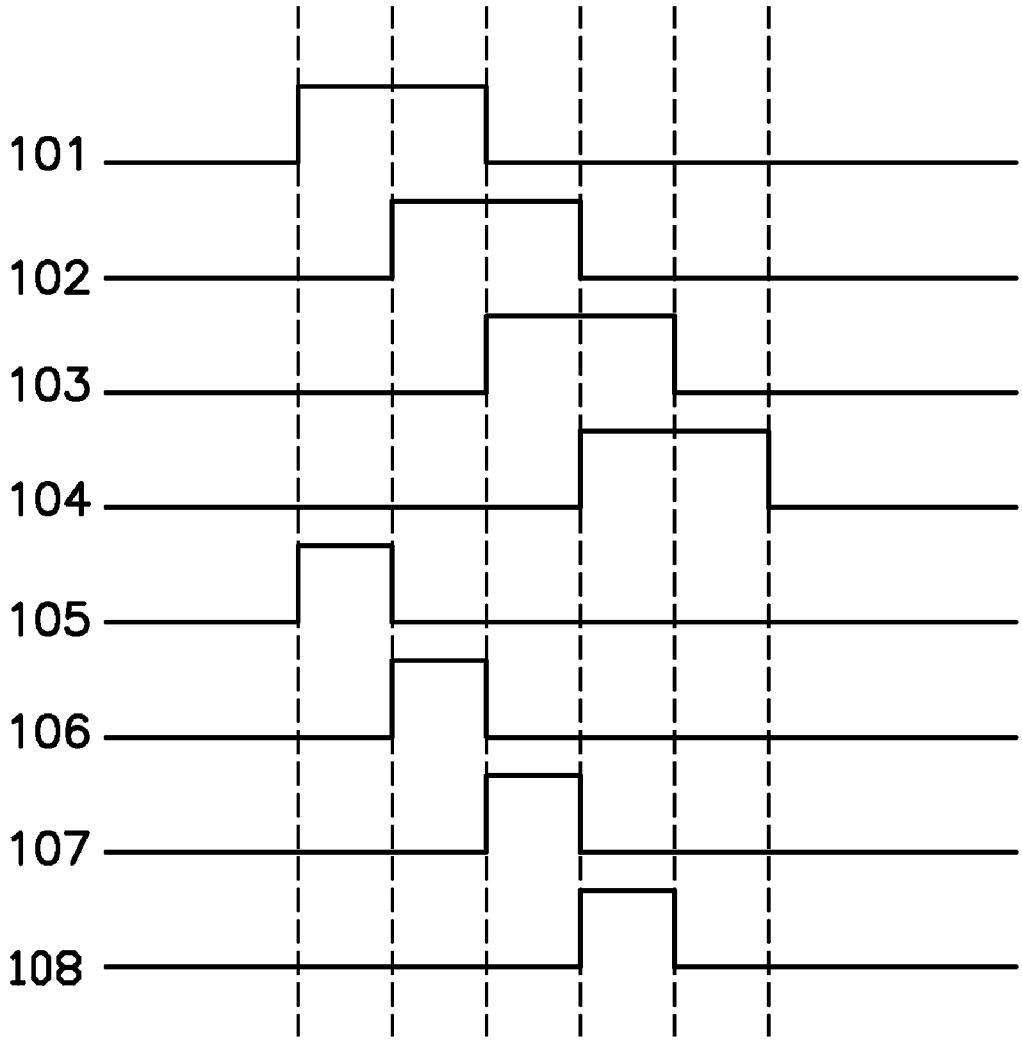
FIG. 1 (PRIOR ART)
FIG. 1 shows an example of shifting signals and panel control signals used to drive display panels.
Figure 2:
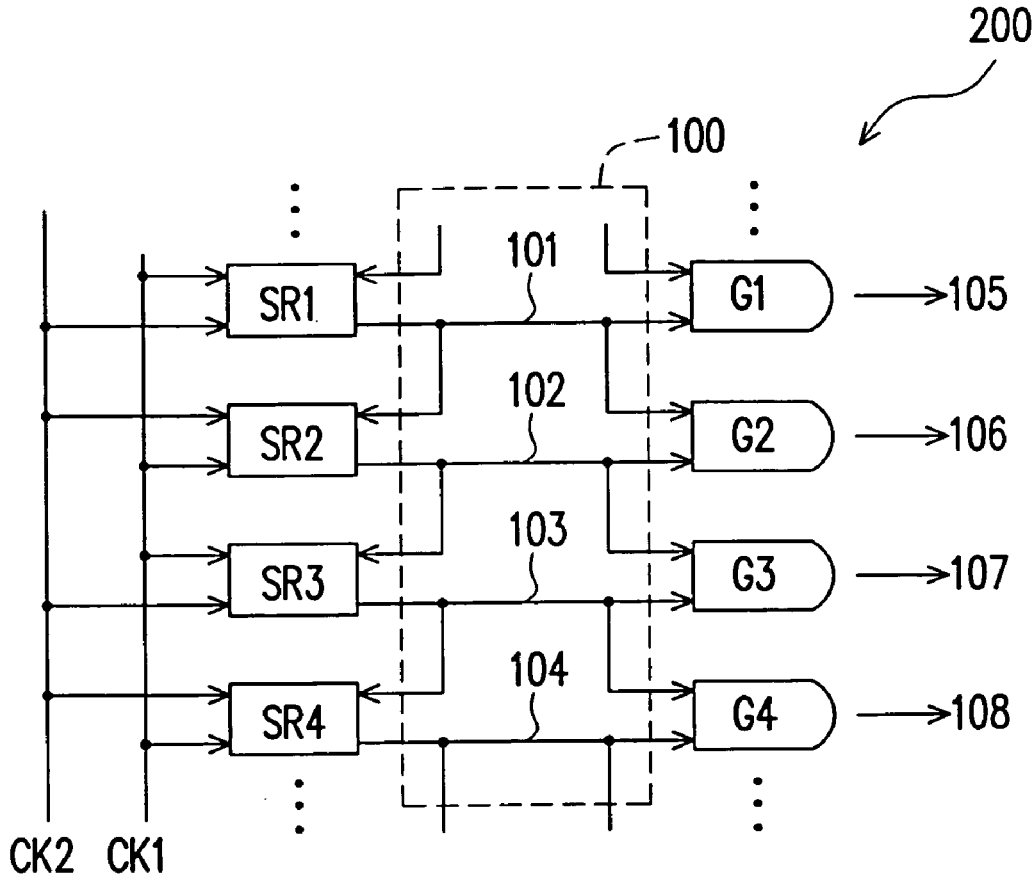
FIG. 2 (PRIOR ART)
FIG. 2 is a schematic diagram showing part of a conventional control circuit for an display panel.

Reference will now be made in detail to the present preferred embodiments of the invention, examples of which are illustrated in the accompanying drawings. Wherever possible, the same reference numbers are used in the drawings and the description to refer to the same or like parts.

Figure 5:
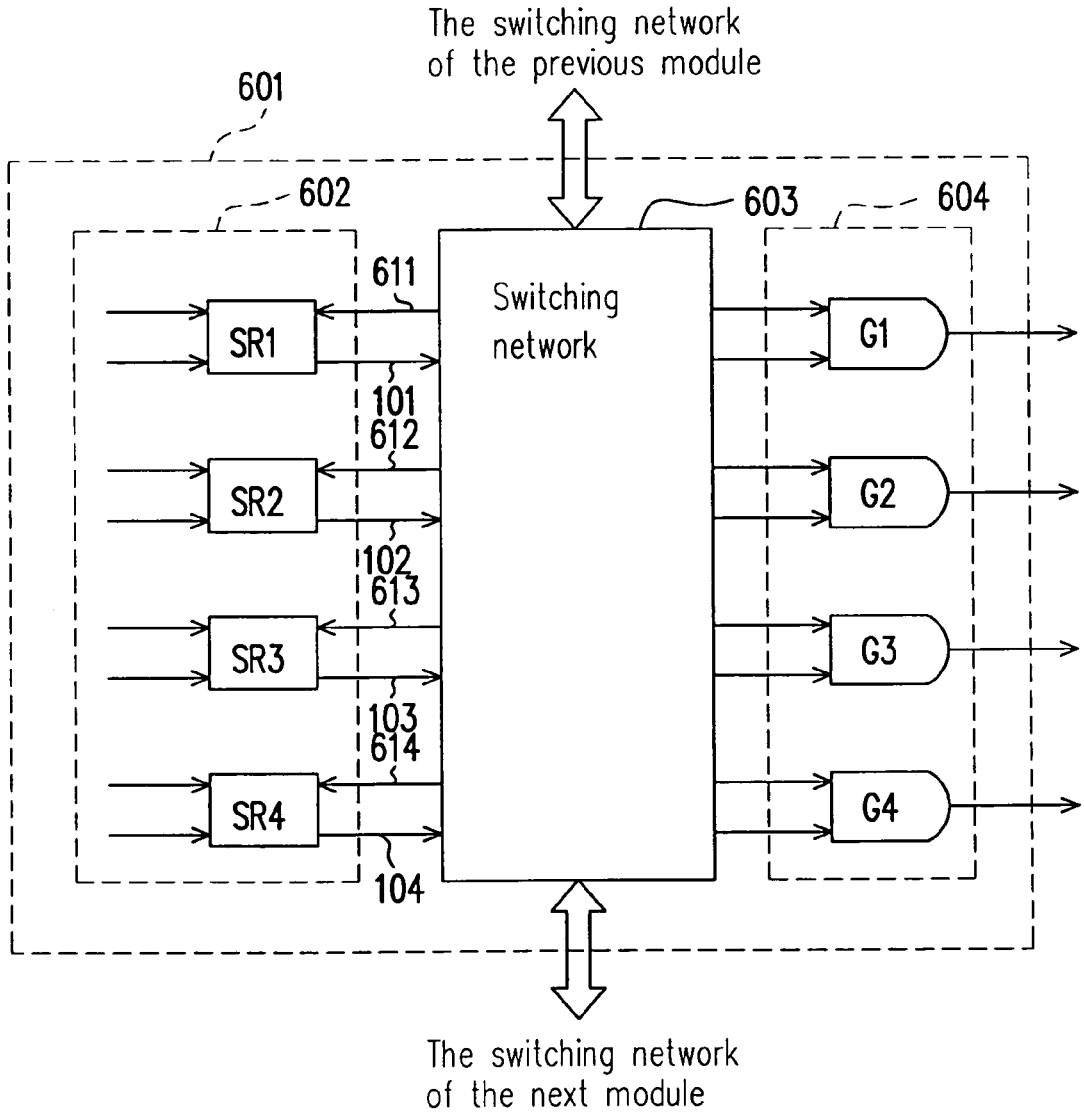
FIG. 5 is a schematic diagram showing a module of a dual resolution control circuit according to an embodiment of the present invention.

In this regard, FIG. 5 is a module of a dual resolution control circuit. The module 601 comprises a shift register array 602, a switching network 603 and a logic gate array 604.

The shift register array 602 comprises four shift registers (SR1~SR4). Each of the shift registers SR1~SR4 outputs a shifting signal (101~104). The logic gate array 604 comprises four logic gates (G1~G4). The switching network 603 is coupled among the shifting registers SR1~SR4, the logic gates G1~G4, a switching network of a previous module, and a switching network of a next module.

In the logic gate array 604, each of the logic gates G1~G4 receives two of the shifting signals and outputs a panel control signal. The switching network 603 selects which of the logic gate receives which of the shifting signals. In this embodiment, the logic gates G1~G4 are AND gates to output panel control signals with high pulses. In some embodiments of the present invention, each of the AND gates is emulated by an NAND gate and an inverter connected in series. In some embodiments of the present invention, the logic gates G1~G4 are NAND gates to output panel control signals with low pulses. Similarly, in some embodiments of the present invention, each of the NAND gates is emulated by an AND gate and an inverter connected in series.

The switching network 603 is coupled among the shifting register array 602, the logic gate array 604, and the switching networks of the previous and the next modules. For many applications, it is desirable to have display panels support a dual resolution and a dual scan direction (both upward and downward). Therefore, the switching network 603 is configured to direct the correct shifting signals to the correct shift registers and the correct logic gates to generate the correct panel control signals, regardless of whether the display panel is in a high resolution mode or in a low resolution mode, or whether the display panel is scanning upward or downward.

Figure 6:
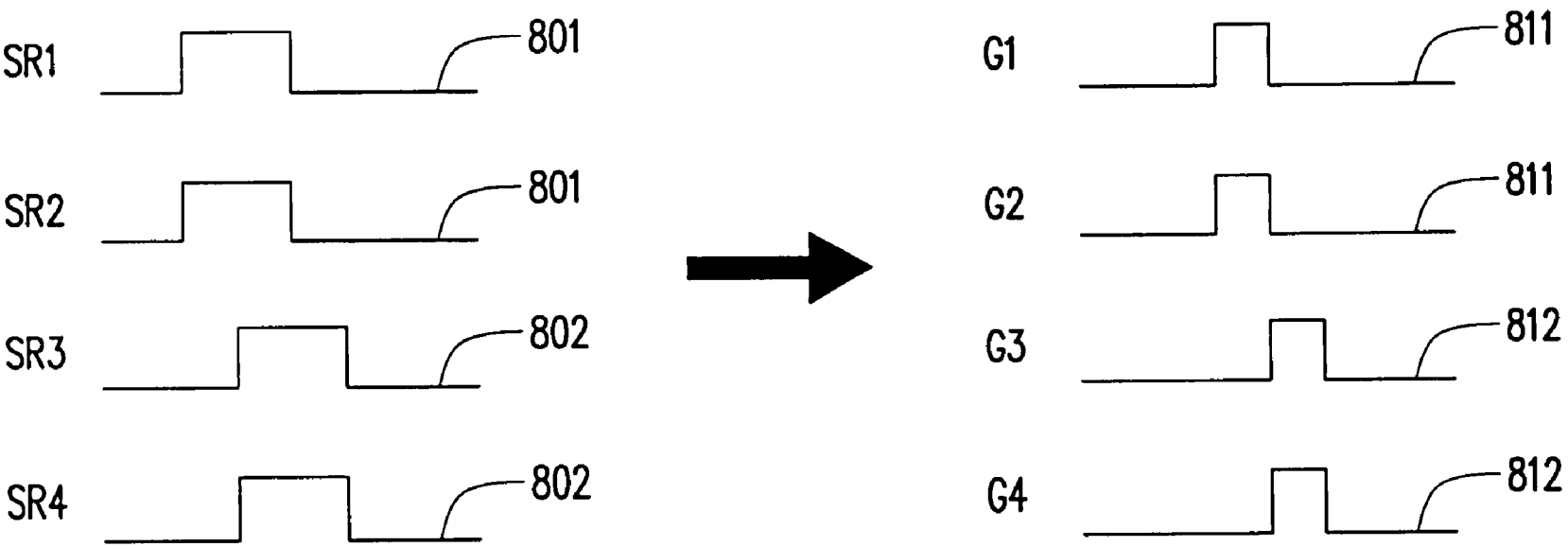
FIG. 6 is a schematic diagram showing the sequence of the operation principle of a dual resolution control circuit according to an embodiment of the present invention.

When the display panel operates in the low resolution mode, the sequence of the operation principle of the module 601 is shown in FIG. 6, wherein the switching network 603 directs the shifting signals to the shift registers such that each of the shift registers SR1 and SR2 outputs a first shifting signal 801 and each of the shift registers SR3 and SR4 outputs a second shifting signal 802. When the display panel operates in the low resolution mode, the switching network 603 also directs the shifting signals to the logic gates G1~G4 such that each of the logic gates G1 and G2 outputs a first panel control signal 811 and each of the logic gates G3 and G4 outputs a second panel control signal 812. The sequence of the panel control signals 811 and 812 do not overlap. Furthermore, the pulse duration of each of the shifting signals 801 and 802 is at least twice as long as the pulse duration of each of the panel control signals 811 and 812.

Figure 7:
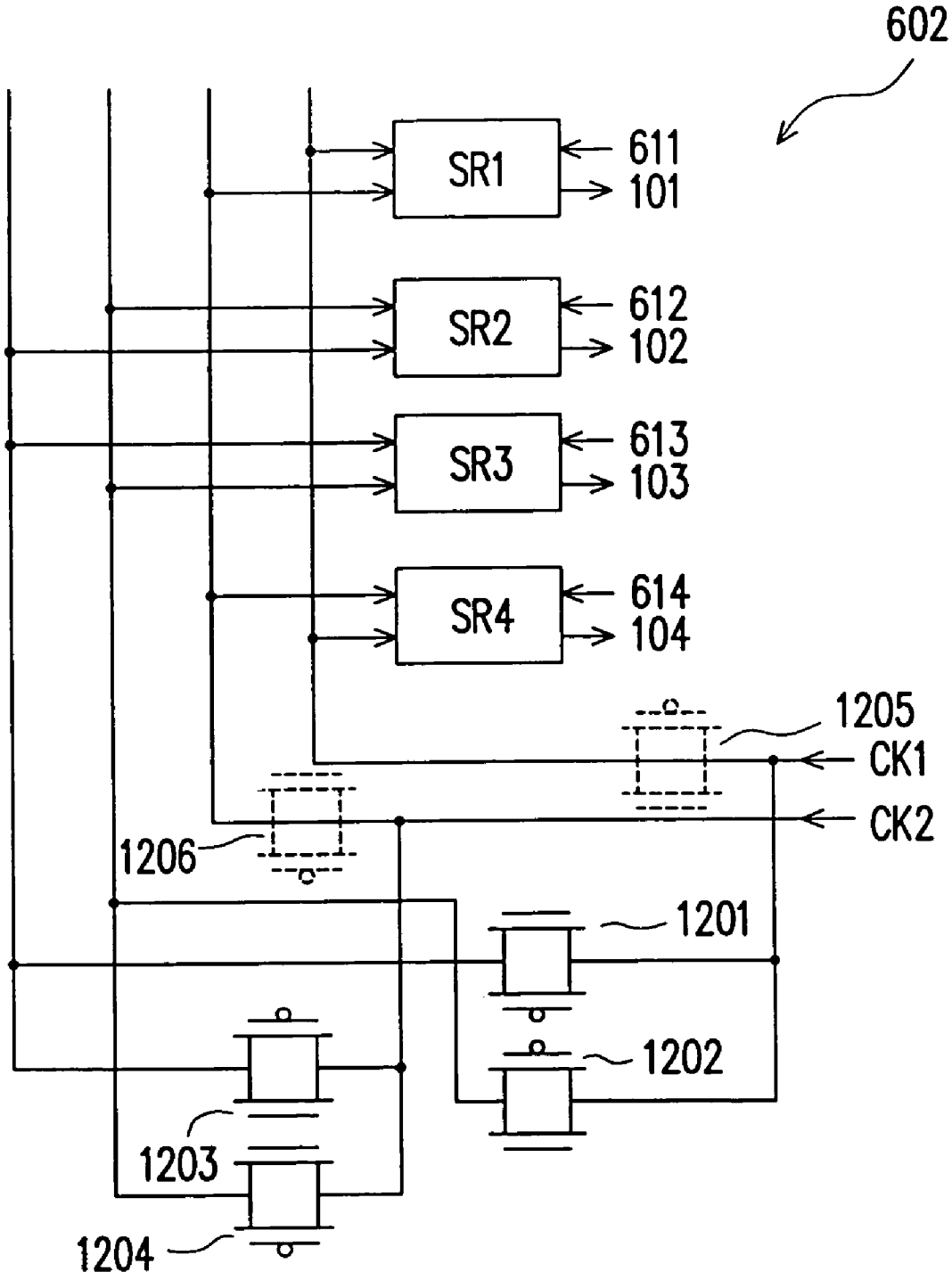
FIG. 7 is a schematic diagram showing the shift register array of a module of a dual resolution control circuit according to an embodiment of the present invention.

The shifting signals provided by the shift registers SR1~SR4 in the high resolution mode are different from those provided by the shift registers SR1~SR4 in the low resolution mode. To achieve the difference, the clock signals provided to the shift registers SR1~SR4 are switched. In this regard, shift register array 602 is illustrated in FIG. 7. Each of the shift registers SR1~SR4 receives the first clock signal CK1 and the second clock signal CK2, receives a shifting signal (611~614) from another shift register as its start pulse input, and outputs its own shifting signal (101~104). The switching network 603 selects which shift register receives which shifting signal as its start pulse input.

Figure 3:
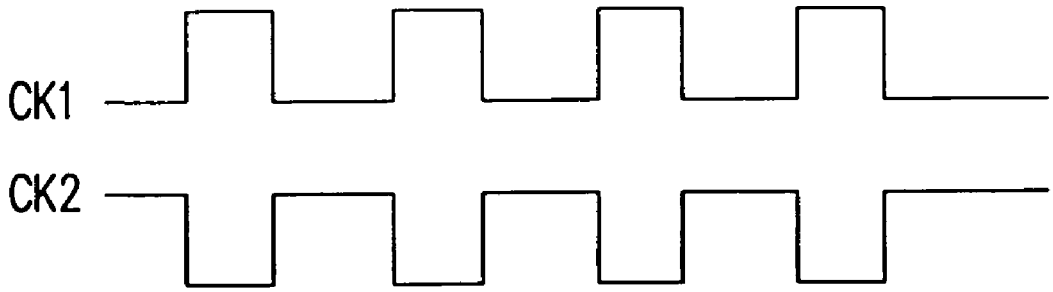
FIG. 3 (PRIOR ART)
FIG. 3 shows an example of conventional clock signals used by shift registers of control circuits for display panels.
Figure 4:
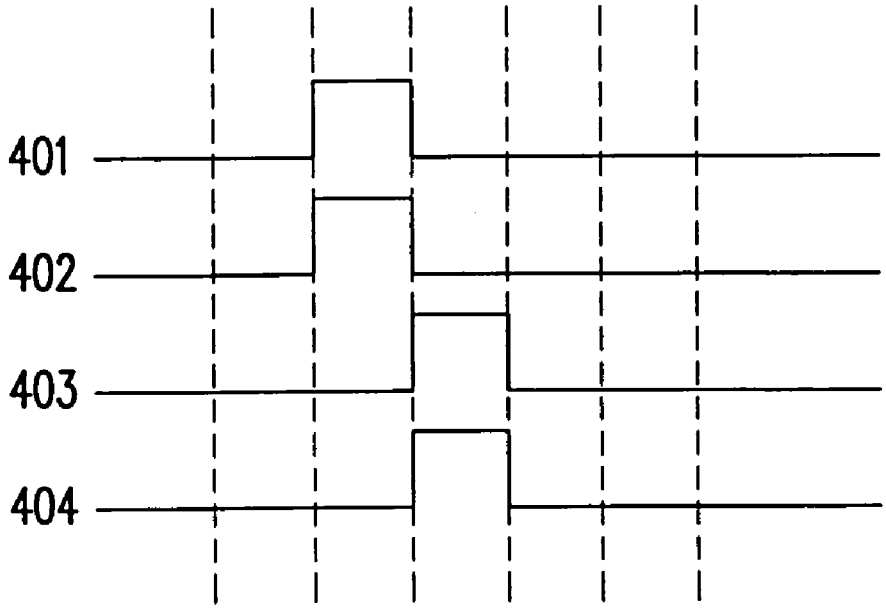
FIG. 4 (PRIOR ART)
FIG. 4 shows an example of conventional panel control signals used to drive display panels in a low resolution mode.

In this embodiment, the first clock signal CK1 and the second clock signal CK2 have the same frequency and are in opposite phases, such as depicted in FIG. 3. The clock signals CK1 and CK2 provided to the shift registers SR1~SR4 are re-arranged [what is meant by "re-arranged"?] in the low resolution mode so that the shifting signals 101 and 102 are identical, and the shifting signals 103 and 104 are identical.

The shift register array 602 further comprises the switches 1201~1204 to control the interconnection between the clock signals and the shift registers. The shift register SR1 receives the first clock signal CK1 as its first input and the second clock signal CK2 as its second input. The shift register SR4 receives the second clock signal CK2 as its first input and the first clock signal CK1 as its second input. The switch 1201 connects the first clock signal CK1 to or disconnects the first clock signal CK1 from the second input of the shift register SR2 and the first input of the shift register SR3. The switch 1202 connects the first clock signal CK1 to or disconnects the first clock signal CK1 from the first input of the shift register SR2 and the second input of the shift register SR3. The switch 1203 connects the second clock signal CK2 to or disconnects the second clock signal CK2 from the second input of the shift register SR2 and the first input of the shift register SR3. The switch 1204 connects the second clock signal CK2 to or disconnects the second clock signal CK2 from the first input of the shift register SR2 and the second input of the shift register SR3.

The delay devices 1205 and 1206 are employed to delay the propagation of the first clock signal CK1 and the second clock signal CK2 to the shift registers SR1 and SR4 to eliminate timing differences among the shifting signals outputted by the shift registers SR1~SR4. The delay device 1205 is coupled among the first clock signal CK1, the first input of the shift register SR1 and the second input of the shift register SR4. The delay device 1206 is coupled among the second clock signal CK2, the second input of the shift register SR1 and the first input of the shift register SR4. In this embodiment, the delay devices 1205 and 1206 are just switches that are always turned on.

The delay devices 1205 and 1206 may be unnecessary if there are no timing differences among the shifting signals outputted by the shift registers SR1~SR4, or if the timing differences are negligible.

Figure 8:
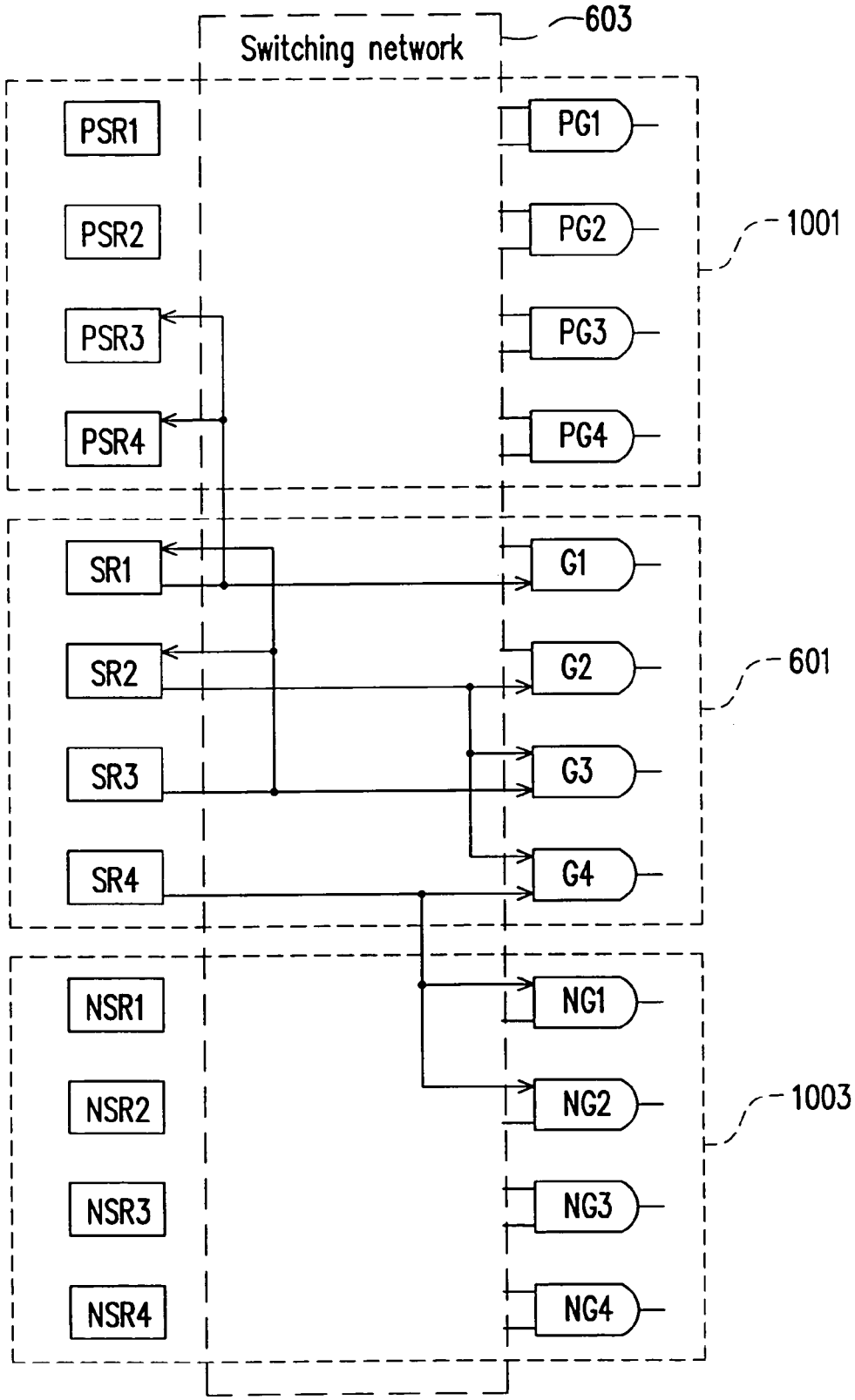
FIG. 8 and FIG. 9 are schematic diagrams showing the interconnection between shift registers and logic gates under the switching network of a dual resolution control circuit according to an embodiment of the present invention.
Figure 9:
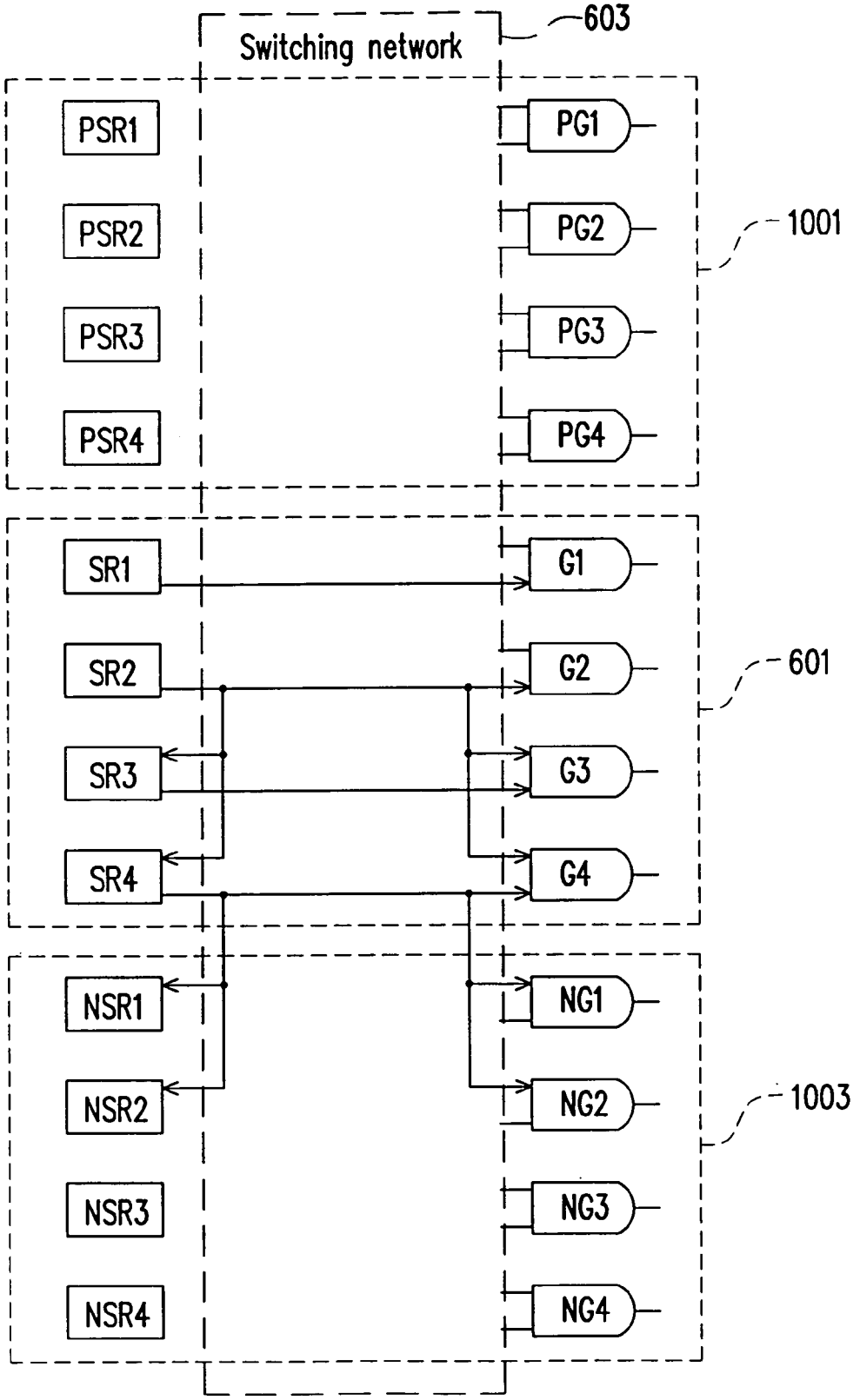

Table 2 below shows how the switching networks in this embodiment direct the shifting signals provided by the shift registers SR1~SR4 in the various situations mentioned above. For clarity, FIG. 8 and FIG. 9 further illustrate the connections between shift registers and logic gates of this embodiment when the display panel operates in the low resolution mode. In particular, FIG. 8 shows the connections when the display panel scans upward in the low resolution mode, and FIG. 9 shows the connections when the display panel scans downward in the low resolution mode. As can be seen, there are three modules in FIG. 8 and FIG. 9, namely, the previous module 1001, the central module 601 and the next module 1003. The previous module 1001 comprises the shift registers PSR1~PSR4 and the logic gates PG1~PG4. The central module 601 comprises the shift registers SR1~SR4 and the logic gates G1~G4. The next module 1003 comprises the shift registers NSR1~NSR4 and the logic gates NG1~NG4. For simplicity, only the transmission paths starting from the central module 601 are shown in FIG. 8 and FIG. 9. Actually, the same transmission pattern is repeated in each module of this embodiment.

TABLE 2

| Resolution and scan direction | Shift register providing the shifting signal | Shift registers and logic gates receiving the shifting signal |
|---|---|---|
| Scanning upward in the high resolution mode | SR1 | PSR4, G1, G2 |
| | SR2 | SR1, G2, G3 |
| | SR3 | SR2, G3, G4 |
| | SR4 | SR3, G4, NG1 |
| Scanning downward in the high resolution mode | SR1 | SR2, G1, G2 |
| | SR2 | SR3, G2, G3 |
| | SR3 | SR4, G3, G4 |
| | SR4 | NSR1, G4, NG1 |
| Scanning upward in the low resolution mode | SR1 | G1, PSR3, PSR4 |
| | SR2 | G2, G3, G4 |
| | SR3 | G3, SR1, SR2 |
| | SR4 | G4, NG1, NG2 |
| Scanning downward in the low resolution mode | SR1 | G1 |
| | SR2 | SR3, SR4, G2, G3, G4 |
| | SR3 | G3 |
| | SR4 | G4, NSR1, NSR2, NG1, NG2 |

One skilled in the relevant art can deduce that the logic gates G1~G4 receive correct shifting signals and generate correct panel control signals in the various situations mentioned above.

As can be seen in table 2 above and in FIG. 8 and FIG. 9, all shift registers are used even when the display panel is in the low resolution mode. Since there are no idle and floating shift registers, the problem caused by accumulated charges is potentially prevented.

Please note that the present invention is not limited to the embodiments discussed above. Regarding the transmission of the shifting signals from the shift registers to the logic gates, there are several variations of the general rule. According to a first variation, when the display panel operates in the low resolution mode, the shift register SR1 outputs a first shifting signal, and the shift register SR2 also outputs the first shifting signal. The switching network directs the first shifting signal to each of the logic gates G1~G4. Meanwhile, the shift register SR3 outputs a second shifting signal, and the shift register SR4 also outputs the second shifting signal. The switching network directs the second shifting signal to the logic gates G3, G4, NG1 and NG2.

According to a second variation of the general rule, when the display panel operates in the low resolution mode, the shift register SR1 outputs a first shifting signal, and the shift register SR2 also outputs the first shifting signal. The switching network directs the first shifting signal to the logic gates PG3, PG4, G1 and G2. Meanwhile, the shift register SR3 outputs a second shifting signal, and the shift register SR4 also outputs the second shifting signal. The switching network directs the second shifting signal to each of the logic gates G1~G4.

Regarding the transmission of the shifting signals among the shift registers themselves, the general rule is as follows. When the display panel scans upward in the low resolution mode, the shift registers SR1 and SR2 receive the shifting signal outputted by the shift register SR3 or the shift register SR4 as their start pulse inputs, and the shift registers SR3 and SR4 receive the shifting signal outputted by the shift register NSR1 or the shift register NSR2 as their start pulse inputs.

On the other hand, when the display panel scans downward in the low resolution mode, the shift registers SR1 and SR2 receive the shifting signal outputted by the shift register PSR3 or the shift register PSR4 as their start pulse inputs, and the shift registers SR3 and SR4 receive the shifting signal outputted by the shift register SR1 or the shift register SR2 as their start pulse inputs.

Finally, regarding the interconnection between the clock signals and the shift registers, the general rule is as follows. When the display panel operates in the high resolution mode, the shift registers SR1 and SR3 receive the first clock signal CK1 as their first inputs and the second clock signal CK2 as their second inputs. And the shift registers SR2 and SR4 receive the first clock signal CK1 as their second inputs and the second clock signal CK2 as their first inputs. On the other hand, when the display panel operates in the low resolution mode, the shift registers SR1 and SR2 receive the first clock signal CK1 as their first inputs and the second clock signal CK2 as their second inputs. And the shift registers SR3 and SR4 receive the first clock signal CK1 as their second inputs and the second clock signal CK2 as their first inputs.

Figure 10:
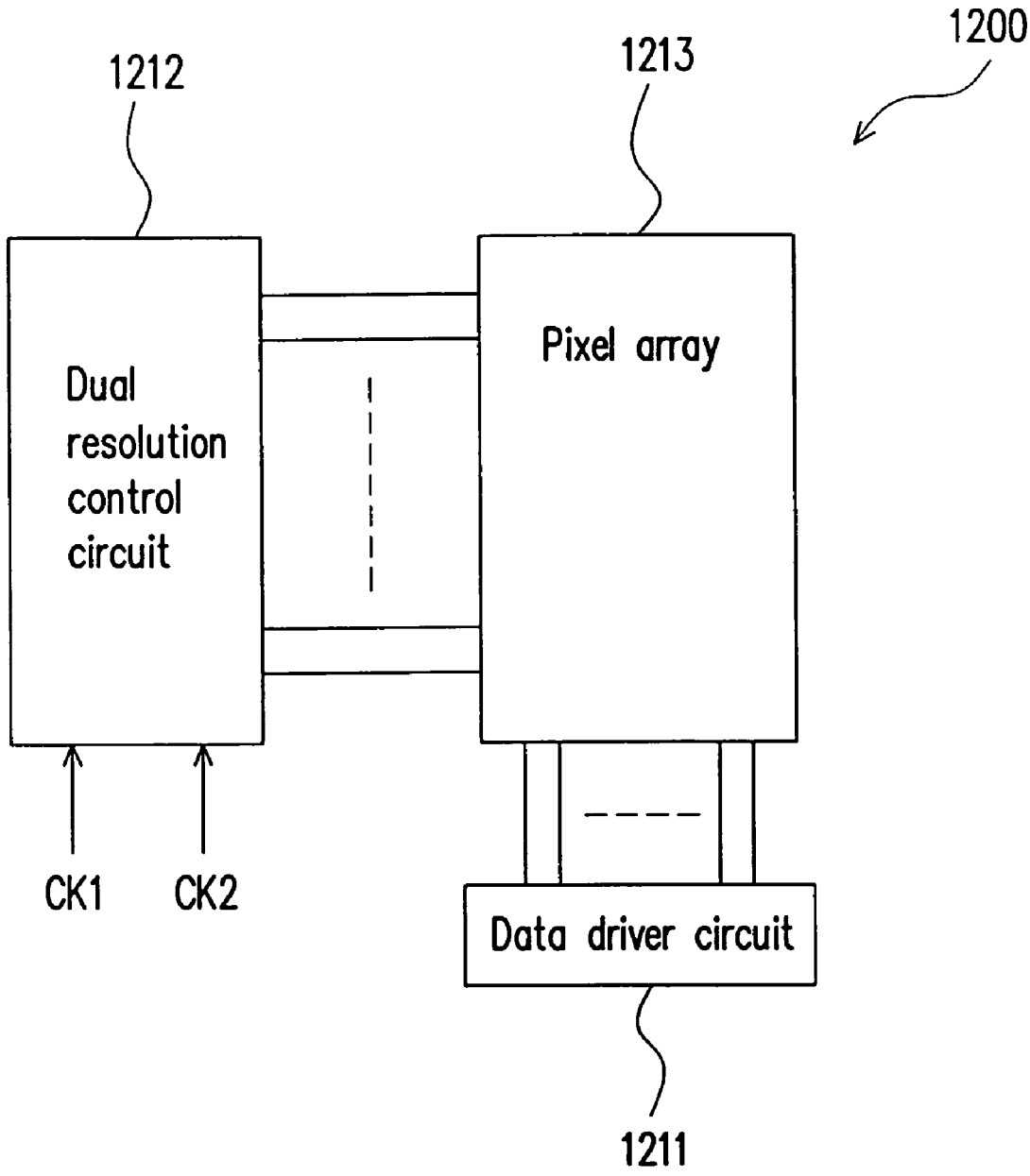
FIG. 10 is a schematic diagram showing the structure of an display panel according to an embodiment of the present invention.

Embodiments of a dual resolution control circuit can be used with display panels, such as shown in FIG. 10. FIG. 10 is a schematic diagram showing a display panel 1200 according to another embodiment of the present invention. The display panel 1200 comprises a data driver circuit 1211, a dual resolution control circuit 1212 and a pixel array 1213. The data driver circuit 1211 provides an image signal to the pixel array 1213. The dual resolution control circuit 1212 provides a plurality of panel control signals to the pixel array 1213 in a manner such as described before. The pixel array 1213 displays an image by loading the image signal into a plurality of pixels of the pixel array 1213 in response to the panel control signals. Because of the dual resolution control circuit 1212, the display panel 1200 might also prevent the problem caused by floating shift registers.

It will be apparent to those skilled in the art that various modifications and variations can be made to the structure of the present invention without departing from the scope or spirit of the invention. In view of the foregoing, it is intended that the present invention cover modifications and variations provided they fall within the scope of the following claims and their equivalents.

What is claimed is:

1. A system for providing dual resolution control of a display panel, said system comprising:

a dual resolution control circuit comprising four shift registers, each of the shift registers outputting a shifting signal;

four logic gates;

a switching network coupled among the shifting registers and the logic gates;

wherein, in a low resolution mode, the switching network directs the shifting signals to the shift registers such that each of the first and the second shift registers outputs a first shifting signal and each of the third and the fourth shift registers outputs a second shifting signal, the switching network also directs the shifting signals to the logic gates such that each of the first and the second logic gates outputs a first panel control signal and each of the third and the fourth logic gates outputs a second panel control signal, and wherein pulses of the first and the second panel control signals do not temporally overlap, and wherein each of the shift registers receives a first clock signal and a second clock signal, receives a shifting signal from another shift register as its start pulse input, and each of output terminals of the shift registers is connected through the switching network to at least one of the logic gates, and a plurality of switches, the switches being operative to direct the first clock signal and the second clock signal to the shift registers such that:

in a high resolution mode, the first shift register and the third shift register receive the first clock signal as their first inputs and the second clock signal as their second inputs, and the second shift register and the fourth shift register receive the first clock signal as their second inputs and the second clock signal as their first inputs; and in the low resolution mode, the first shift register and the second shift register receive the first clock signal as their first inputs and the second clock signal as their second inputs, and the third shift register and the fourth shift register receive the first clock signal as their second inputs and the second clock signal as their first inputs.

2. The system according to claim 1, wherein durations of the pulses of each of the shifting signals are at least twice as long as the durations of the pulses of each of the panel control signals.

3. The system according to claim 1, wherein, in the low resolution mode, the switching network directs the first shifting signal to each of the four logic gates, and directs the second shifting signal to the third logic gate, the fourth logic gate, a first logic gate of a next module, and a second logic gate of the next module.

4. The system according to claim 1, wherein, in the low resolution mode, the switching network directs the first shifting signal to a third logic gate of a previous module, a fourth logic gate of the previous module, the first logic gate, and the second logic gate, and directs the second shifting signal to each of the four logic gates.

5. The system according to claim 1, wherein, during upward scan in the low resolution mode, the first shift register and the second shift register receive the shifting signal outputted by the third shift register or the fourth shift register as their start pulse inputs, and the third shift register and the fourth shift register receive the shifting signal outputted by the first shift register of the next module or the second shift register of the next module as their start pulse inputs.

6. The system according to claim 1, wherein, during downward scan in the low resolution mode, the first shift register and the second shift register receive the shifting signal outputted by the third shift register of the previous module or the fourth shift register of the previous module as their start pulse inputs, and the third shift register and the fourth shift register receive the shifting signal outputted by the first shift register or the second shift register as their start pulse inputs.

7. The system according to claim 1, wherein the switches comprises a first switch, a second switch, a third switch, and a fourth switch, and the first switch connects the first clock signal to or disconnects the first clock signal from the second input of the second shift register and the first input of the third shift register;

the second switch connects the first clock signal to or disconnects the first clock signal from the first input of the second shift register and the second input of the third shift register;

the third switch connects the second clock signal to or disconnects the second clock signal from the second input of the second shift register and the first input of the third shift register; and the fourth switch connects the second clock signal to or disconnects the second clock signal from the first input of the second shift register and the second input of the third shift register.

8. The system according to claim 7, further comprising:

a first delay device coupled among the first clock signal, the first input of the first shift register and the second input of the fourth shift register; and a second delay device coupled among the second clock signal, the second input of the first shift register and the first input of the fourth shift register;

wherein the first delay device and the second delay device are operative to delay propagation of the first clock signal and the second clock signal to the first shift register and the fourth shift register to reduce timing differences among the shifting signals outputted by the shift registers.

9. The system according to claim 1, wherein the first clock signal and the second clock signal have the same frequency and are in opposite phases.

10. The system according to claim 1, wherein each of the logic gates comprises an AND gate, an NAND gate, an AND gate and an inverter connected in series, or an NAND gate and an inverter connected in series.

11. The system according to claim 1, wherein the first shifting signals respectively output from the first shift register and the second shift register have the same timing and waveform, the second shifting signals respectively output from the third shift register and the fourth shift register have the same timing and waveform, and the first shifting signal and the second shifting signal have the same waveform but different timing.

* * * * *